US010463908B1

(12) United States Patent
Kim

(10) Patent No.: US 10,463,908 B1
(45) Date of Patent: Nov. 5, 2019

(54) MULTI GRIP ASSEMBLY FOR HEALTH DEVICE

(71) Applicant: Jung Won Kim, Seongnam-si (KR)

(72) Inventor: Jung Won Kim, Seongnam-si (KR)

( * ) Notice: Subject to any disclaimer, the term of this patent is extended or adjusted under 35 U.S.C. 154(b) by 0 days.

(21) Appl. No.: 16/352,856

(22) Filed: Mar. 14, 2019

(30) Foreign Application Priority Data

Mar. 22, 2018 (KR) ..... 10-2018-0032995

(51) Int. Cl.
*A63B 21/062* (2006.01)
*A63B 21/00* (2006.01)
*A63B 21/072* (2006.01)

(52) U.S. Cl.
CPC ..... *A63B 21/4035* (2015.10); *A63B 21/062* (2013.01); *A63B 21/063* (2015.10); *A63B 21/0624* (2015.10); *A63B 21/0626* (2015.10); *A63B 21/0628* (2015.10); *A63B 21/0724* (2013.01); *A63B 2209/00* (2013.01)

(58) Field of Classification Search
CPC ..... A63B 21/062; A63B 21/0622; A63B 21/0624; A63B 21/0626; A63B 21/0628; A63B 21/063; A63B 21/0632; A63B 21/0724; A63B 21/4035; A63B 2209/00
See application file for complete search history.

(56) References Cited

U.S. PATENT DOCUMENTS 4,749,188 A * 6/1988 Montgomery ..... A63B 21/0602 482/106
4,779,867 A 10/1988 Hinds
5,588,942 A * 12/1996 Dillard ..... A63B 21/4035 482/106
7,066,866 B1 * 6/2006 Mobley ..... A63B 1/00 482/40
7,819,784 B1 * 10/2010 Caswell ..... A63B 21/1627 482/904
8,177,694 B1 * 5/2012 Walker ..... A63B 1/00 482/126
8,979,717 B2 * 3/2015 Glickstein ..... A63B 21/068 482/143
9,486,668 B2 * 11/2016 Williams ..... A63B 21/0628
9,999,802 B2 * 6/2018 Kilmon ..... A63B 7/00
2014/0141949 A1 5/2014 Mills et al.
2015/0024907 A1 1/2015 Ross

* cited by examiner

*Primary Examiner* — Joshua Lee
(74) *Attorney, Agent, or Firm* — Lee & Associates, LLC; Jake K. Lee

(57) ABSTRACT

The present invention relates to a multi grip assembly including: a support bar formed in the shape of a bar having a predetermined length, including a coupling hook detachably coupled to an upper portion of the health device, and a pair of position movement rails left and right formed through an inside along a longitudinal direction with respect to a center; a pair of grips movably coupled to the pair of position movement rails and gripped by both hands of the user, wherein each of the pair of grips includes: a grip body of a closed figure shape in which a user's hand is gripped; and a support bar coupling ring coupled to an upper portion of the grip body and fitted in the pair of position movement rails to move along the pair of position movement rails by an external force, wherein the pair of position movement rails include a plurality of grip fixing grooves which are recessively formed in a lower inner direction at predetermined distances along the longitudinal direction to fix a position of the support bar coupling ring.

1 Claim, 6 Drawing Sheets

MULTI GRIP ASSEMBLY FOR HEALTH DEVICE

CROSS-REFERENCE TO RELATED APPLICATIONS

The present application claims the benefit of Korean Patent Application No. 10-2018-0032995 filed in the Korean Intellectual Property Office on Mar. 22, 2018, the entire contents of which are incorporated herein by reference.

TECHNICAL FIELD

The present invention relates to a multi grip assembly for a health device, and more particularly, to a multi grip assembly for a health device that is detachably coupled to various types of health devices that a user uses by hands to conveniently adjust a distance between both hands and exercise.

BACKGROUND

Recently, as the interest in health has increased, the number of people who are exercising for their health or for a good body shape at the gym is increasing. At the gym, various types of health device are used to exercise muscles of the body parts desired by a user.

FIG. 1 is a diagram showing a health device A called lat pull down. As shown in FIG. 1, a user P holds a pull down grip 10 with both hands and pulls it down to repeatedly raise and lower a weight for arm and back muscle exercise.

Here, the pull down grip 10 stimulates the inside of the back part a little more when a distance between both hands is narrow, and stimulates the back muscle of the outside such as latissimus muscle of back a little more when the distance between both hands is wide. In other words, a body area where the exercise effect concentrates according to a distance W between both hands holding the pull down grip 10.

In addition, a stimulating part where the exercise effect concentrates is different according to a direction in which the pull down grip 10 is gripped with the hands, that is, an angle of the wrist held by the back of the hand directed toward a user's face or held by the palm directed toward the user's face. However, there is a problem in that a reverse lat cross grip, which holds the hand in the opposite direction such that the palm is directed toward the user's face, may be a poison to a person with a bad wrist.

Various types of grips have been developed to improve the exercise effect of the inside part of the back in consideration of the inconvenience of the wrist.

For example, as shown in FIG. 2A, a parallel grip 20 allows the palms to face each other and balance to proceed with an exercise movement. The parallel grip 20 is useful to stimulate deep inside the back by isolating the back of the scapula (the wing bone) a little further inward when it is held wide like the pull down grip 10.

The parallel grip 20 is advantageous in that a user with the bad wrist may do exercise without any burden.

Meanwhile, FIG. 2B is an example diagram showing a close grip 30. The close grip 30 is designed to eliminate the discomfort of the wrist and to stimulate the inside part of the back. The close grip 30 is effective to stimulate the inside and the lower back by maintaining a comfortable angle of the wrist without a large rotation of the wrist.

At present, at the gym, even if the same health device is used, the user selectively uses the various types of grips 10, 20, and 30 described above according to the desired body part where the exercise effect concentrates and the wrist state of the user. Accordingly, a fitness center operator must have all kinds of grips, and it is burdensome to detach the grips corresponding to each health device for each user and burdensome to manage the grips.

SUMMARY

Accordingly, the present invention has been made in view of the above-mentioned problems occurring in the prior art, and it is an object of the present invention to a grip assembly for a health device capable of easily adjusting a gripping distance between a right hand and a left hand.

It is another object of the present invention to provide a grip assembly for a health device capable of rotating a grip and adjusting a grip direction according to a body part to which a user intends to stimulate.

It is another object of the present invention to provide a grip assembly for a health device which can be used not only in a health device for pulling down like a lat pull down but also in a health device for pulling up like a T-bar row.

The above objects and various advantages of the present invention will become more apparent from the preferred embodiments of the present invention by those skilled in the art.

To accomplish the above-mentioned objects, according to the present invention, there is provided a multi grip assembly for a health device coupled to the health device to allow a user to grip the multi grip assembly with both hands and apply a force on the health device, the multi grip assembly including: a support bar formed in the shape of a bar having a predetermined length, including a coupling hook detachably coupled to an upper portion of the health device, and a pair of position movement rails left and right formed through an inside along a longitudinal direction with respect to a center; a pair of grips movably coupled to the pair of position movement rails and gripped by both hands of the user, wherein each of the pair of grips includes: a grip body of a closed figure shape in which a user's hand is gripped; and a support bar coupling ring coupled to an upper portion of the grip body and fitted in the pair of position movement rails to move along the pair of position movement rails by an external force, wherein the pair of position movement rails include a plurality of grip fixing grooves which are recessively formed in a lower inner direction at predetermined distances along the longitudinal direction to fix a position of the support bar coupling ring.

According to the present invention, desirably, a bushing may be coupled to an area of the support bar coupling ring that is in contact with the pair of position movement rails, a grip body coupling shaft inserted into the grip body may protrude from a lower portion of the support bar coupling ring at a predetermined length, a shaft fitting hole through which the grip body coupling shaft is inserted may be formed through an upper portion of the grip body, and a bearing for supporting the grip body to rotate with respect to the grip body coupling shaft may be provided between the shaft fitting hole and the grip body coupling shaft.

According to the present invention, desirably, a shaft insertion groove may be provided in a lower portion of a central region of the support bar, the shaft insertion groove being recessed at a predetermined length in an inner direction such that a shaft of the health device is inserted.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
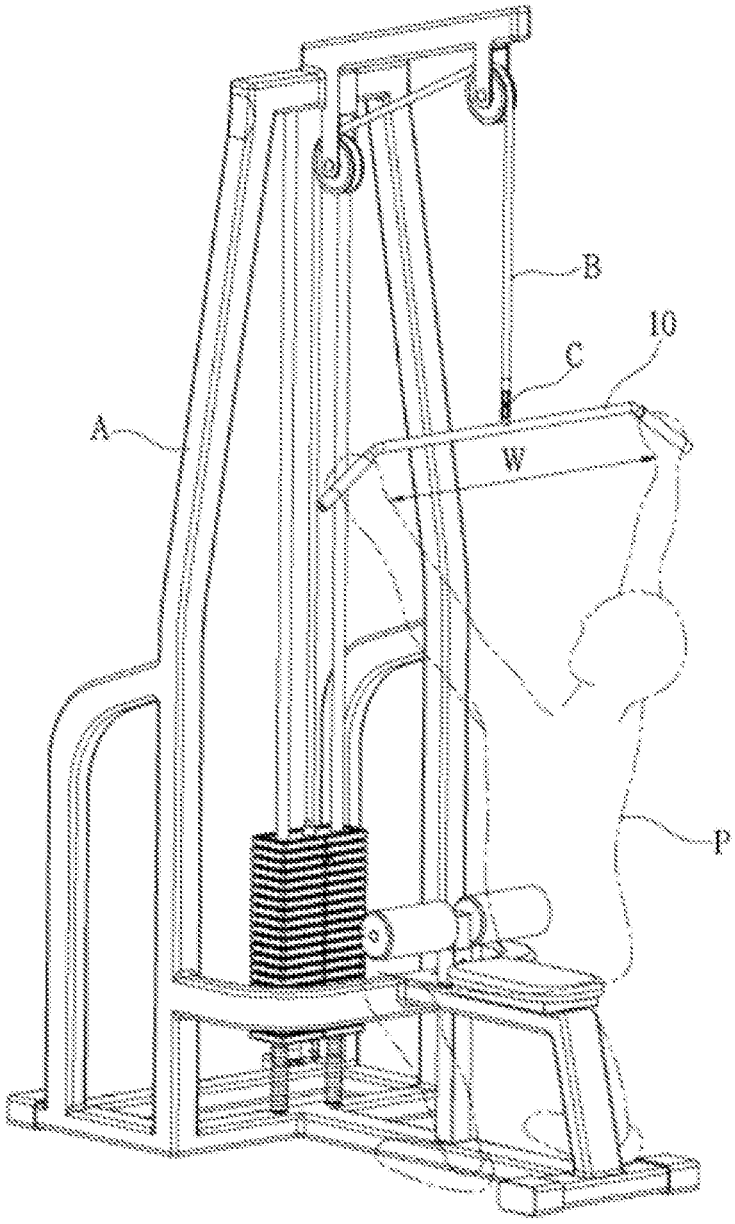
FIG. 1 is an example view showing an example of a pull down grip used in combination with a conventional health device.

For a better understanding of the present invention, a preferred embodiment of the present invention will be described with reference to the accompanying drawings. The embodiments of the present invention may be modified into various forms, and the scope of the present invention should not be construed as being limited to the embodiments described in detail below. The present embodiments are provided to enable those skilled in the art to more fully understand the present invention. Therefore, the shapes and the like of the elements in the drawings can be exaggeratedly expressed to emphasize a clearer description. It should be noted that in the drawings, the same members are denoted by the same reference numerals. Detailed descriptions of well-known functions and constructions which may be unnecessarily obscured by the gist of the present invention are omitted.

Figure 3:
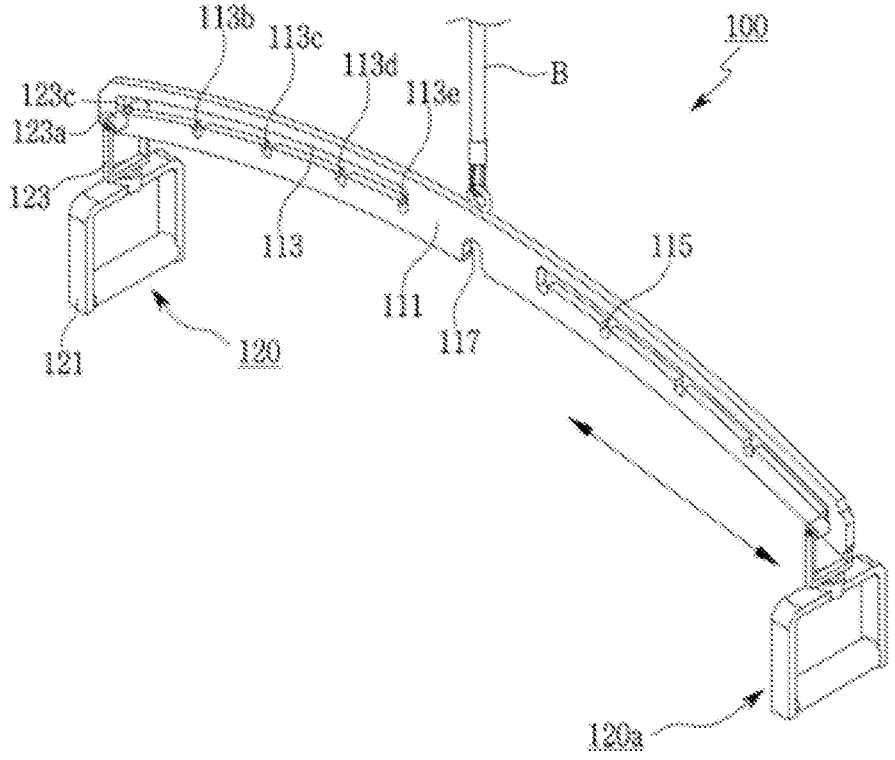
FIG. 3 is a perspective view showing a configuration of a grip assembly according to the present invention.
Figure 4:
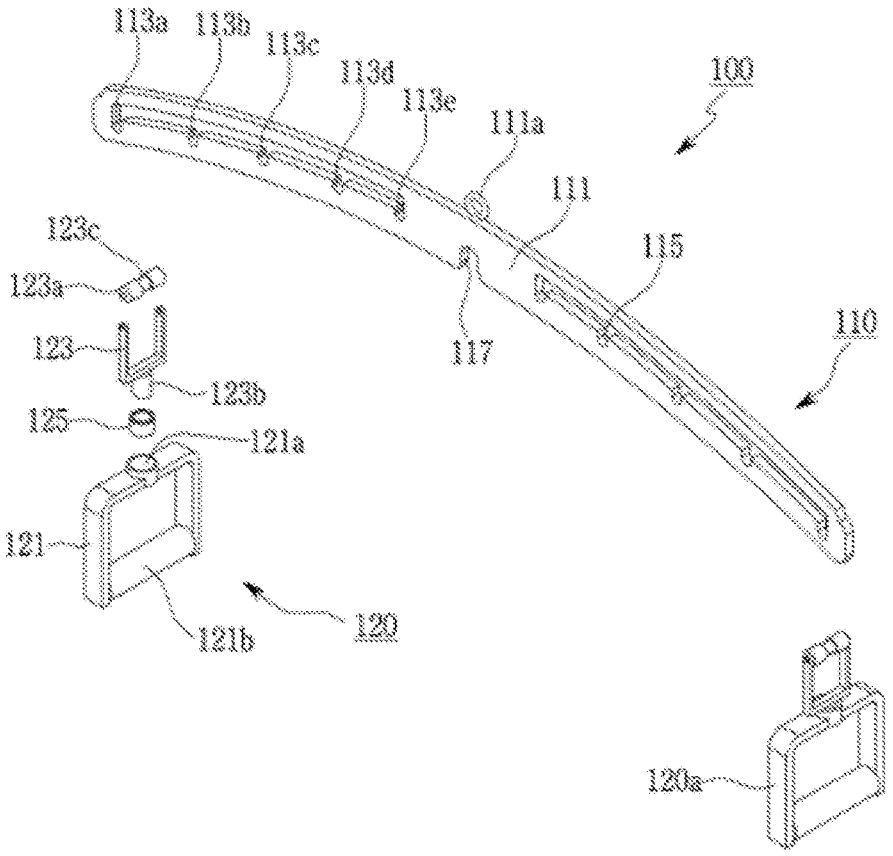
FIG. 4 is an exploded perspective view of a grip assembly according to the present invention.

FIG. 3 is a perspective view showing a configuration of a multi grip assembly 100 of the present invention, and FIG. 4 is an exploded perspective view of the configuration of the multi grip assembly 100.

As shown, the multi grip assembly 100 includes a bar-shaped support bar 110 having a predetermined length and a pair of grips 120 and 120*a* coupled to the support bar 110 to be gripped by hands of a user.

Here, in the multi grip assembly 100 according to the present invention, a pair of position movement rails 113 and 115 having a predetermined length left and right are formed through an inside of the support bar 110, and the pair of grips 120 and 120*a* are movably coupled to the corresponding position movement rails 113 and 115, respectively. The user can adjust positions of the pair of grips 120 and 120*a* in consideration of a body region requiring intense exercise stimulation desired by the user.

Figure 2A:
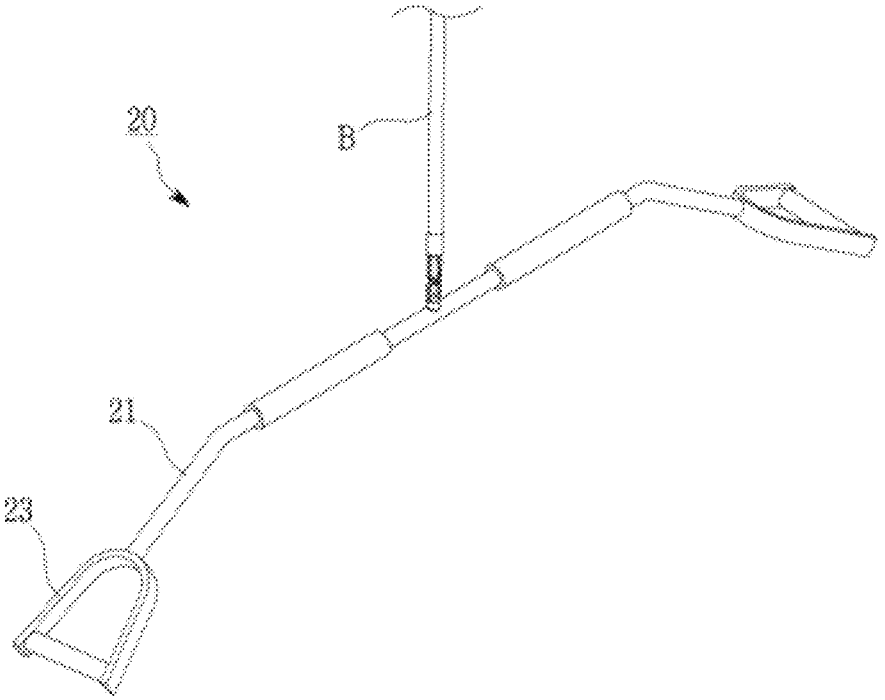
FIGS. 2A and 2B are example views showing an example of a parallel grip and a close grip used in combination with a conventional health device.
Figure 2B:
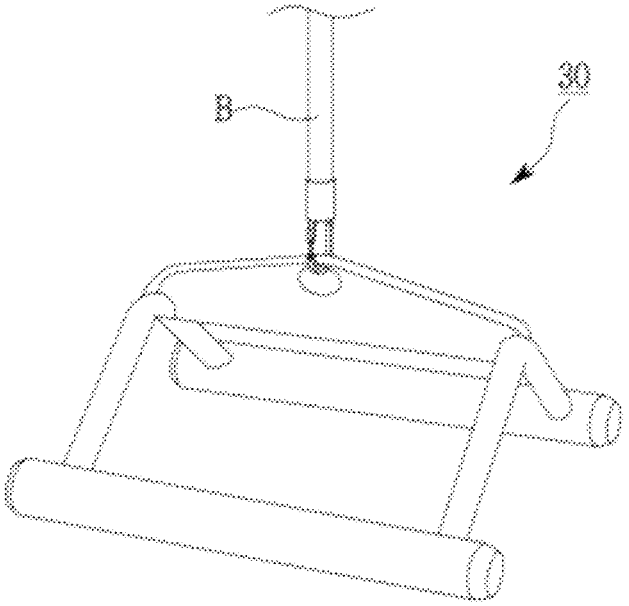

Accordingly, it is possible to eliminate the inconvenience of the conventional grips 10, 20, and 30 of FIGS. 1, 2A and 2B in which various types of grips must be attached and detached to adjust the position between the grips 120 and 120*a*.

The support bar 110 movably supports the pair of grips 120 and 120*a* and is coupled to a coupling wire B of the health device A. The support bar 110 includes a bar-shaped support bar body 111 having a predetermined length, a coupling hook 112 provided in an upper portion of a central region of the support bar body 111 and coupled to the coupling wire B of the health device A, and the pair of position movement rails 113 and 115 formed on both sides of the inside of the support bar body 111 at a predetermined length.

The support bar body 111 may be formed horizontally as metal bar, and may have a predetermined curvature as shown in the figure. In this case, the curvature is preferably formed such that a height decreases from the center to the outside.

A coupling ring 111*a* is provided in an upper portion of a central region of the support bar body 111. The coupling ring 111*a* is integrally coupled to the support bar body 111 by welding or the like. The coupling ring 111*a* may be connected directly to the coupling wire B of the health device A or may be coupled to the coupling hook 112 as shown and connected to the coupling wire B.

The pair of position movement rails 113 and 115 are formed by being cut into a predetermined length inside the support bar body 111. The lengths of the position movement rails 113 and 115 are preferably relatively long such that the user can select an exercise effect for various body regions according to the positions of the grips 120 and 120*a*.

At this time, the pair of position movement rails 113 and 115 are provided with a plurality of grip fixing grooves 113*a*, 113*b*, 113*c*, 113*d*, and 113*e* which are recessed at certain distances. The grip fixing grooves 113*a*, 113*b*, 113*c*, 113*d* and 113*e* allow a support bar coupling ring 123 of the grips 120 and 120*a* to be fixed on the position movement rails 113 and 115.

That is, the plurality of grip fixing grooves 113*a*, 113*b*, 113*c*, 113*d*, and 113*e* are recessively formed on the position movement rails 113 and 115 such that the user can use the grips 120 and 120*a* by fitting the support bar coupling ring 123 into the desired grip fixing grooves 113*a*, 113*b*, 113*c*, 113*d*, and 113*e* and fixing the positions of the grips 120 and 120*a*.

If there is no grip fixing grooves 113*a*, 113*b*, 113*c*, 113*d*, and 113*e*, while the user grips the grips 120 and 120*a* and doing exercise, the grips 120 and 120*a* move along the position movement rails 113 and 115, which may be burdensome to repeatedly adjust the positions of the grips 120 and 120*a*.

Here, a position of each of the grip fixing grooves 113*a*, 113*b*, 113*c*, 113*d*, and 113*e* is preferably designed according to the body region where the exercise effect concentrates. For example, the position can be designed such as when the first grip fixing groove 113*a* moves the outside back muscle, the second grip fixing groove 113*b* stimulates the entire back muscle, and the third grip fixing groove 113*c* stimulates the inner part and the lower part of the back, etc.

The five grip fixing grooves 113*a*, 113*b*, 113*c*, 113*d*, and 113*e* are formed in the preferred embodiment of the present invention but this is merely an example. In some cases, the number of the grip fixing grooves 113*a*, 113*b*, 113*c*, 113*d*, and 113*e* can be added or subtracted.

Here, a shaft insertion groove 117, which is recessed inwardly, is provided in a lower portion of the central region of the support bar body 111. The shaft insertion groove 117 can be used to fit a health device having a shaft, for example, a barbell shaft of a T-bar row, as shown in FIG. 6.

Figure 6:
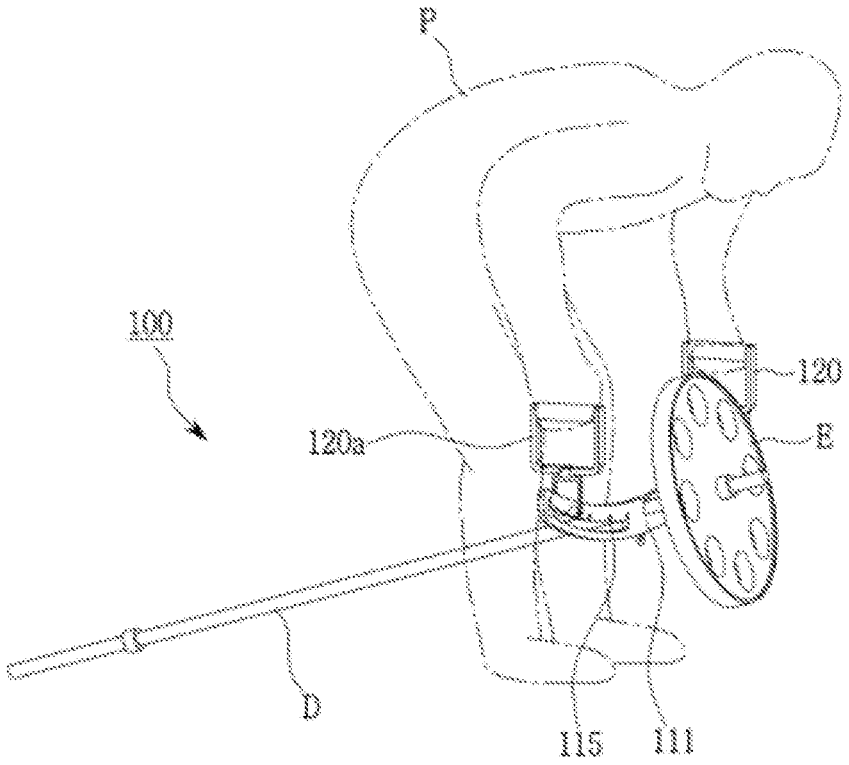
FIG. 6 is an example view showing a process of coupling a grip assembly according to the present invention to a T-bar row.

In other words, when the support bar body 111 is coupled to a health device for lifting or lowering the weight by lowering the arm with the arm extended like a lat pull down shown in FIG. 1, the coupling ring 111*a* is used, and when the support bar body 111 is coupled to a health device for lifting the weight upwardly like the T-bar row in which a weight D is coupled to a shaft D as shown in FIG. 6, the shaft D is inserted into the shaft insertion groove 117 and used.

This allows the multi grip assembly 100 of the present invention to be used interchangeably with various types of health devices.

The pair of grips 120 and 120*a* are respectively fitted to the left position movement rail 113 and the right position movement rail 115 such that both hands of the user are gripped. The configurations of the pair of grips 120 and 120*a* are the same as each other.

The grips 120 and 120*a* include a grip body 121 on which the user's hand is gripped and the support bar coupling ring 123 provided in an upper portion of the grip body 121 and fitted to the position movement rails 113 and 115 of the support bar body 111.

The grip body 121 can be easily gripped by the user's hand and is provided such that a grip state can be stably maintained. To this end, the grip body 121 is preferably formed in a closed figure shape such as a rectangle, a circle, a triangle, or a trapezoid.

A shaft fitting hole 121*a* into which a grip body coupling shaft 123*b* of the support bar coupling ring 123 is inserted is formed through the upper portion of the grip body 121. A cushion member 121*b* may be coupled to a lower portion of the grip body 121, that is, a portion in which the user's hand touches in order to improve grip feeling at the time of gripping.

The support bar coupling ring 123 is formed in the shape of "E" having an open upper portion, and a hook coupling shaft 123*c* is coupled to the open upper portion to have a rectangular closed ring shape. The height of the support bar coupling ring 123 is preferably designed in consideration of the thickness of the support bar body 111 on which the position movement rails 113 and 115 are formed for the easy movement of the support bar coupling ring 123.

The hook coupling shaft 123*c* is rotatably coupled to the support bar coupling ring 123. At this time, a pair of bushings 123*a* are fitted on both sides of the axis of the hook coupling shaft 123*c*. When the user tries to move the grips 120 and 120*a* to the left and right by applying an external force, the bushing 123*a* rotates in contact with a side surface of the support bar body 111 such that the hook coupling shaft 123*c* can be moved more easily.

The hook coupling shaft 123*c* exposed between the pair of bushings 123*a* rotates by being inserted into the position movement rails 113 and 115 and moves on the position movement rails 113 and 115.

A grip body coupling shaft 123*b* protrudes from a lower portion of the support bar coupling ring 123. The grip body coupling shaft 123*b* is fitted in the shaft fitting hole 121*a* of the grip body 121. At this time, a bearing 125 is inserted between the grip body coupling shaft 123*b* and the shaft fitting hole 121*a*. The bearing 125 allows the grip body 121 to rotate with respect to the grip body coupling shaft 123*b* and the user to adjust the wrist direction with respect to the support bar 110.

A process of using the multi grip assembly 100 of the present invention having such a configuration will be described with reference to FIGS. 3 to 6.

A manager couples the multi grip assembly 100 of the present invention to a health device, such as the lat pull down shown in FIG. 1. As shown in FIG. 3, the multi grip assembly 100 is connected to the coupling wire B of the health device A by using the coupling hook 112.

Figure 5A:
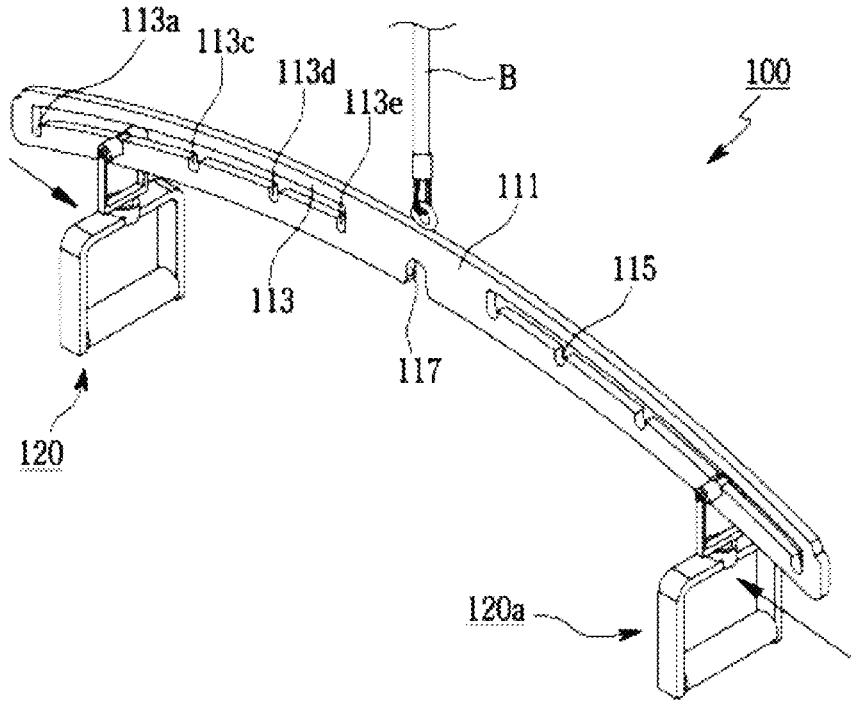
FIGS. 5A and 5B are example views showing a process of adjusting a distance between grips using a grip assembly according to the present invention.
Figure 5B:
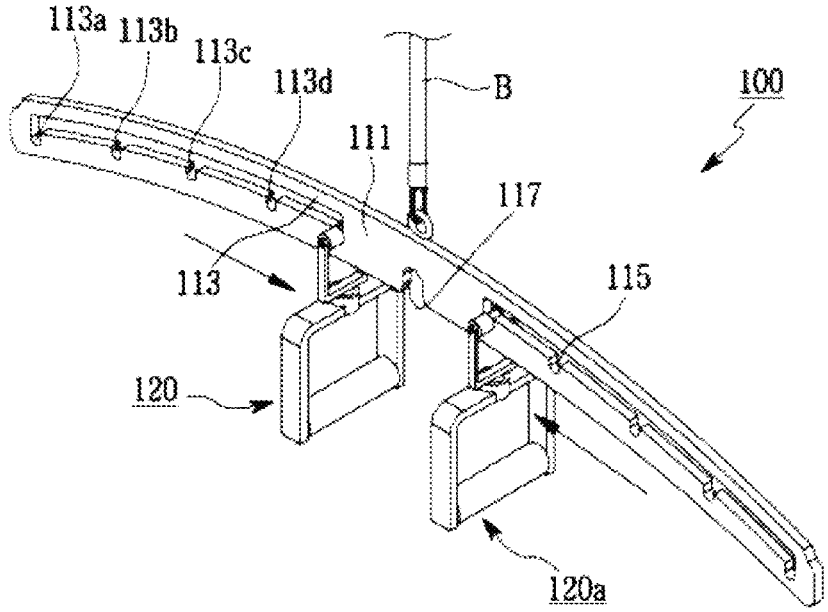

As shown in FIGS. 5A and 5B, the user adjusts the distance between the pair of grips 120 and 120*a* according to body muscles that the user intensively intends to exercise.

That is, when the muscles outside the back are to be stimulated, the grips 120 and 120*a* are positioned in the first grip fixing groove 113*a* as shown in FIG. 3.

On the other hand, when the entire back muscles are to be exercised, the grips 120 and 120*a* are positioned in the second grip fixing groove 113*b* as shown in FIG. 5A. When the user pulls the grip body 121 located in the first grip fixing groove 113*a* toward the second grip fixing groove 113*b*, the hook coupling shaft 123*c* rotates and moves out of the first grip fixing groove 113*a*, and at the same time, the both bushings 123*a* rotate in contact with both side surfaces of the support bar body 111. Whereby the support bar coupling ring 123 is moved along the position movement rails 113 and 115.

When the second grip fixing groove 113*b* is reached, the hook coupling shaft 123*c* is fitted into the second grip fixing groove 113*b* by the shape of the second grip fixing groove 113*b* and the position is fixed.

In some cases, when the innermost muscle is to be exercised, the user pulls the grips 120 and 120*a* continuously toward the fifth grip fixing groove 113*e* as shown in FIG. 5B in the same manner such that the support bar coupling ring 123 is positioned in the fifth grip fixing groove 113*e*.

When the positions of the grips 120 and 120*a* are adjusted, the user pulls the grip body 121 downward to exercise. During the exercise, the user can rotate the grip body 121 with respect to the grip body coupling shaft 123*b* to stimulate the muscles at different positions.

That is, the user can stimulate body muscles at various positions while moving the position of the grip body 121 using the one multi grip assembly 100, and can stimulate another muscle by rotating the grip body 121.

Conventionally, in order to achieve the same effect, various kinds of grips corresponding to each body muscle must be changed while exercising. However, in the present invention, since all the exercise effects can be implemented by using the one multi grip assembly 100, the user can save the exercise effect, since the number of grips to be provided is reduced, the manager can reduce the management cost and can avoid burden of exchanging the grips.

Meanwhile, the multi grip assembly 100 of the present invention can be applied to the T-bar row health device as shown in FIG. 6. The user then adjusts the distance between the pair of grips 120 and 120*a* in the same manner as before. Then, the user grips the grips 120 and 120*a*, lifts the weight E, and exercises.

Accordingly, the multi grip assembly 100 is used in compatibility with various types of health devices.

As described above, the multi grip assembly according to the present invention can freely adjust the position where the user grips the grip, that is, the distance between the pair of grips, and thus there is an effect of stimulating various body muscles using one multi grip assembly.

Further, the multi grip assembly of the present invention can rotate the grip while gripping the grip without changing a direction in which the user grips the grip.

In addition, the multi grip assembly of the present invention can be coupled to a health device for pulling down as well as a health device for pulling up, and thus can be used in compatibility with various kinds of health devices.

On the other hand, the support bar body 111 may be made of a metallic material, and the support bar body 111 of the metallic material is coated with a corrosion-resistant coating layer to prevent corrosion, and the coating material of the corrosion-resistant coating layer includes 20% by weight of tolyltriazole, 15% by weight of benzimidazole, 10% by weight of trioctylamine, 15% by weight of hafnium and 40% by weight of aluminum oxide, and the coating thickness is 8 μm.

Tolyltriazole, benzimizazole, and trioctylamine serve to prevent corrosion and prevent discoloration.

Hafnium is a corrosion-resistant transition metal element that serves to providing excellent waterproof and corrosion resistance.

Aluminum oxide is added for the purpose of refractoriness and chemical stability.

The reason for the numerical limitation of the ratio of the configuration components and the coating thickness as described above is that the present inventor has analyzed through several experiment results, and as a result, showed the optimum corrosion prevention effect at the above ratio.

In addition, the shaft insertion groove 117 may be formed with an anti-contamination coating layer coated with a composition for preventing contamination in order to effectively prevent and remove the adhesion of a contamination material.

The anti-contamination coating composition includes alkanolamide and amphopropionate in a molar ratio of 1:0.01 to 1:2, and the total content of alkanolamide and amphopropionate is 1 to 10% by weight.

The molar ratio of alkanolamide and amphopropionate is preferably in the range of 1:0.01 to 1:2. Thus, when the molar ratio is out of the range, there is a problem in that the coating layer is removed since the coating property of the base material is lowered or the moisture adsorption on the surface after coating is increased.

The alkanolamide and amphopropionate preferably have an amount of 1 to 10% by weight in the aqueous solution of the total composition. Thus, when the amount is less than 1% by weight, there is a problem in that the coating property of the base material is deteriorated and when the amount exceeds 10% by weight, the crystal precipitation is likely to occur due to an increase in the thickness of the coating layer.

On the other hand, as a method of applying the present anti-contamination coating composition to the shaft insertion groove 117, it is preferable to apply the coating composition by using a spray method. The thickness of the final coating layer on the base material is also preferably 500 to 2000 Å, more preferably 1000 to 2000 Å. When the thickness of the coating layer is less than 500 Å, there is a problem of deterioration in the case of high temperature annealing. When the thickness is more than 2000 Å, there is a problem in that the crystal precipitation of the coating surface is likely to occur.

The anti-contamination coating composition of the present invention also may be prepared by adding 0.1 mol of alkanolamide and 0.05 mol of amphopropionate to 1000 mL of distilled water and then stirring the distilled water.

The grips 120 and 120*a* may be coated with an air freshener material having a function of treating respiratory diseases or the like, thereby exhibiting an effect on the fatigue recovery of the user, the health promotion, etc.

The air freshener material may be mixed with functional oil. A mixture ratio is 3 to 5% by weight of the functional oil and 95 to 97% by weight of an air freshener. The functional oil includes 50% by weight of tangerine oil and 50% by weight of palmitoleic acid oil.

Here, the functional oil is preferably mixed with 3 to 5% by weight with respect to the air freshener. If the mixture ratio of the functional oil is less than 3% by weight, the effect is insignificant. If the mixture ratio of the functional oil exceeds 3 to 5% by weight, the function is not greatly improved, but the manufacturing cost is greatly increased.

In the functional oil, the tangerine oil may have citronellol, linalool, cital, etc. as main chemical components and has a good effect on relieving stress, etc. through aseptic, spasmolytic, and sedative functions.

The palmitoleic acid oil works as an antioxidant, is good for dry or aged skin, and has an excellent effect on cell regeneration, sterilization, skin inflammation treatment, etc.

As the functional oil is coated on the grips 120 and 120*a*, it contributes to the fatigue recovery of the user, the health promotion, etc.

The multi grip assembly according to the present invention is capable of freely adjusting a position at which the user grips the grip, that is, a distance between the pair of grips, resulting in the effect of stimulating various body muscles using the one multi grip assembly.

Further, the multi grip assembly of the present invention can rotate the grip while gripping the grip without changing the direction in which the user grips the grip.

In addition, the multi grip assembly of the present invention can be coupled to a health device for pulling down as well as a health device for pulling up, and can be used in compatibility with various kinds of health devices.

The embodiment of the multi grip assembly for a health device of the present invention described above is merely an example, and those skilled in the art will appreciate that various modifications and equivalent embodiments are possible without departing from the scope of the present invention. Therefore, it is to be understood that the present invention is not limited to the above-described embodiments. Accordingly, the true scope of the present invention should be determined by the technical idea of the appended claims. It is also to be understood that the invention includes all modifications, equivalents, and alternatives falling within the spirit and scope of the invention as defined by the appended claims.

What is claimed is:

1. A multi grip assembly for a health device coupled to the health device to allow a user to grip the multi grip assembly with both hands and apply a force on the health device, the multi grip assembly comprising:

a support bar formed in the shape of a bar having a predetermined length, comprising a coupling hook detachably coupled to an upper portion of the health device, and a pair of position movement rails formed through an inside of the support bar along a longitudinal direction;

a pair of grips movably coupled to the pair of position movement rails and gripped by both hands of the user, wherein each of the pair of grips comprises:

a grip body of a closed figure shape in which a user's hand is gripped; and a support bar coupling ring coupled to an upper portion of the grip body and fitted in one of the pair of position movement rails to move along said one of the pair of position movement rails by an external force, wherein the pair of position movement rails comprise a plurality of grip fixing grooves which are recessively formed in a lower portion of the rails at predetermined distances along the longitudinal direction to fix a position of the support bar coupling ring, wherein a shaft insertion groove is provided in a lower portion of a central region of the support bar, the shaft insertion groove being recessed at a predetermined length to allow a shaft of the health device to be inserted, wherein a bushing is coupled to an area of the support bar coupling ring that is in contact with the pair of position movement rails, wherein a grip body coupling shaft inserted into the grip body protrudes from a lower portion of the support bar coupling ring at a predetermined length, wherein a shaft fitting hole through which the grip body coupling shaft is inserted is formed through an upper portion of the grip body, and wherein a bearing for supporting the grip body to rotate with respect to the grip body coupling shaft is provided between the shaft fitting hole and the grip body coupling shaft.

* * * * *